United States Patent [19]

Kupcikevicius et al.

[11] 4,023,329

[45] May 17, 1977

[54] POULTRY PACKAGING APPARATUS

[75] Inventors: Vytautas Kupcikevicius; Vytas Andrew Raudys, both of Chicago, Ill.

[73] Assignee: Union Carbide Corporation, New York, N.Y.

[22] Filed: Feb. 10, 1975

[21] Appl. No.: 548,699

[52] U.S. Cl. ..... 53/259; 53/261
[51] Int. Cl.[2] ..... B65B 1/06
[58] Field of Search ..... 53/255, 258, 259, 260, 53/261, 187; 198/160, 131

[56] References Cited

UNITED STATES PATENTS

| | | | |
|---|---|---|---|
| 2,841,817 | 7/1958 | Murph | 198/131 X |
| 2,885,850 | 5/1959 | Smith | 53/258 |
| 3,052,075 | 9/1962 | Velasquez | 53/259 |
| 3,553,924 | 1/1971 | Bonami | 53/260 X |

*Primary Examiner*—Leon Gilden
*Attorney, Agent, or Firm*—Maurice W. Ryan

[57] ABSTRACT

Poultry articles are advanced on an upwardly inclined conveyor one at a time through a wing and neck training jig mechanism which forms each such article into a packaging configuration, and, at the top of the upwardly inclined conveyor, tilted downwardly to advance by gravity into a stretched open flexible packaging bag at a packaging station.

15 Claims, 16 Drawing Figures

10
107
BIRD POSITIONER CYLINDER
113
127
TRIP LEVER CYLINDER
31
CRADLE LIMIT VALVE
129
115
119
PRODUCT TRIP VALVE
POWER SOURCE
12
31
29
CLUTCH CYLINDER
24
55
GUIDE ARM CYLINDER
START VALVE
56
58
PRODUCT TRIP VALVE
49
20

POULTRY PACKAGING APPARATUS

This invention relates to the packaging of poultry articles in flexible plastic film packaging bags, particularly to the packaging of turkeys, and more particularly to an automated turkey packaging technique wherein turkey carcasses are moved, one at a time, on an upwardly inclined conveyor, while whereon, the portions of the bird which tend to protrude or depend from the main mass of the carcass, such as wings and neck flap skin, are trained in against the carcass by jig-like elements to form a package-conforming shape, and each bird carcass is then tipped over the topmost portion of the conveyor to fall by gravity into a plastic film bag held open at the mouth by guide elements.

Industry has long sought to automate, insofar as possible, packaging operations involved in preparing products for the market. To the extend that a multiplicity or series of products is alike as to size, shape, and weight, fuller automation of the packaging technique is obtainable. In the food packaging industry, however, particularly in the area of meat packaging, the products to be packaged frequently are not alike in a series as to size, weight and shape, and tend less towards automation, more towards the involvement, to a greater or lesser degree, of human handling. It is a desideratum in the retail sale. packaging of meat products that human handling be held to a minimum towards the maintenance of strict sanitary conditions. In the packaging of poultry products, particularly turkeys, the products, carcasses of the birds, are somewhat similar in size, shape, and weight in any given flock, or can be so selected to accomplish an effective and efficient turkey packaging run sequence. Many methods are in general use for the packaging of turkeys into plastic bags made from basically nonextensible plastic film materials. In general practice, a turkey is removed from a conveyor system which is transporting it towards a packaging station, weighed by an operator who then places a bag of a size preselected to the turkey and marked with the weight of the bird atop the carcass, and replaces the bird back on the conveyor, whereon it is transported to a bagging or packaging station where another operator packages the bird in the bag and replaces the bagged bird on the conveyor for transport to stations for evacuation, clip closing, heat shrinking and other typically encountered phases of the packaging operation. Present day turkey packaging practice involves the use of printed bags which bear indicia indicating the manufacturer's label, cooking instructions, product warranty, and other printed material. If such bags fit the turkey carcasses too loosely, the labeling on the package either wrinkles or is forced askew of the symmetry of the package, spoiling the aesthetic appearance of the packaged article and making printed indicia on the bag illegible. It is therefore most desirable to have a reasonably tight-fitting bag on each turkey. Towards this end, the bags selected are normally snug or tight-fitting, and the bag mouths are stretched somewhat to accommodate the entrance of the turkey carcass thereinto in the bagging operation. It has been found in practice that under such conditions, the turkeys must be forced or pushed into the bag either by a human operator or by some sort of pushing element, either of which mode of action tends either to bruise or distort the bird carcass, or, in some instances, to cause bag tearing, with a consequent slow-down of the operation to provide a new weight-marked bag and insert the turkey being packaged thereinto. Thus, while it is desirable on the one hand to have turkey bags snugly fit the turkey carcasses so that the printed indicia on the bag labels is clear and easily readable, and nicely symmetrical on the package article, the accomplishment of this necessitates the pushing or forcing of birds into the bags in such a manner as to cause unwanted bruising of the bird carcass itself, with consequent discoloration and/or destruction of the bag which, if it is too small for the bird being inserted, will tear.

With this then being the state of the art, the present invention was conceived and developed to provide a turkey packaging technique which permits the insertion of turkey carcasses into snugly fitting plastic film bags without the need for pushing, forcing, or touching of the bird carcasses by hand.

The invention further provides a technique for the packaging of turkeys which avoids the undue stretching and tearing of snugly fitting bags in the packaging process.

A further and significant advantage provided by the present invention is a packaging technique wherein printed labels and other indicia on snugly fitting turkey packaging bags are left readable and clearly useful on the finished package article.

A further and significant contribution of this invention is the provision of a turkey packaging technique which, for the first time in the industry, provides a means for packaging turkeys in printed plastic bags so that members such as wings, legs, neck skin flap are uniformly pressed to the carcasses resting in the bags, and are in consistently similar positions in respect of the arrangements of labels on the bags, printed indicia and other bag markings, making for a uniform and attractive series of products for display purposes and for retail sale.

A further and important contribution of the present invention is the provision of a turkey packaging technique which involves only minimal human handling, and wherein, in fact, the need for human touching of the turkeys being packaged is, in the bagging operation itself, completely eliminated.

These and other features, advantages, and details of the present invention will be the more readily understood and appreciated from the ensuing more detailed description and from the drawings, wherein:

FIG. 1 as a side elevation view of an apparatus according to the invention;

Figures 8, 15:
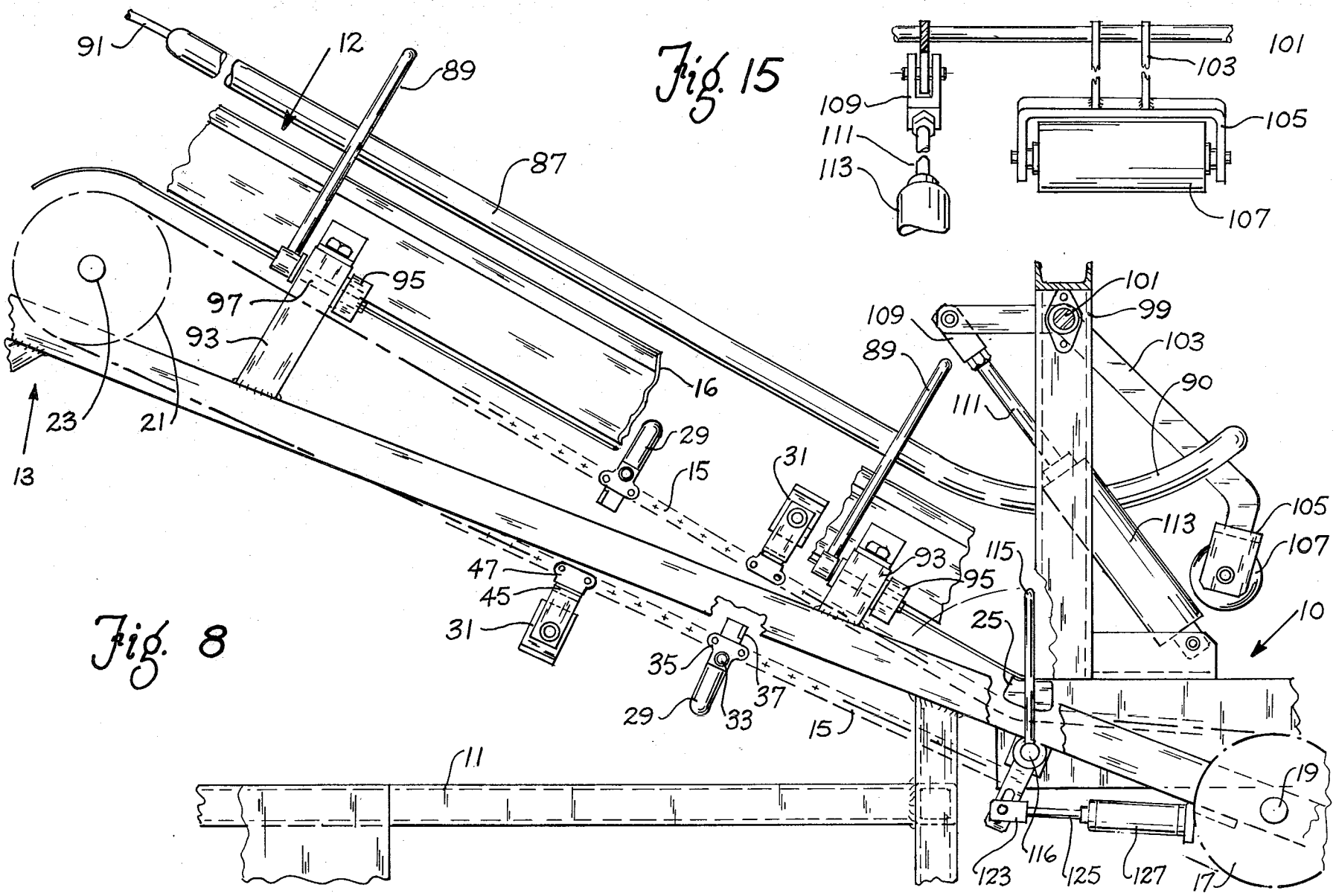
FIG. 8 is a side-elevation schematic view showing details of the conveyor and bird positioner portions of apparatus according to the invention.
Figure 12:
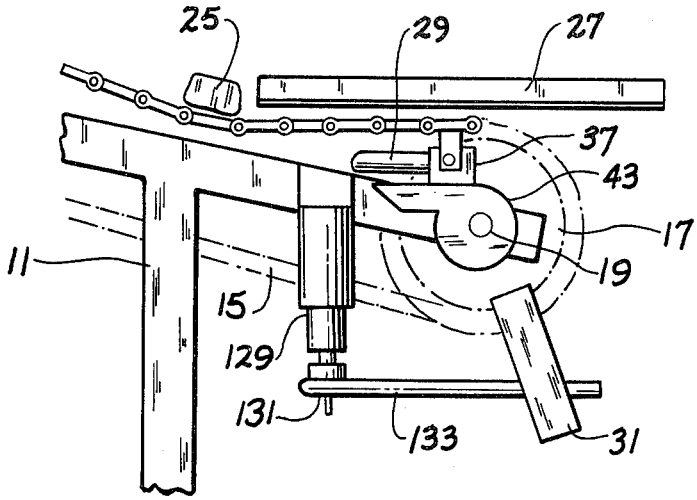
Figure 13:
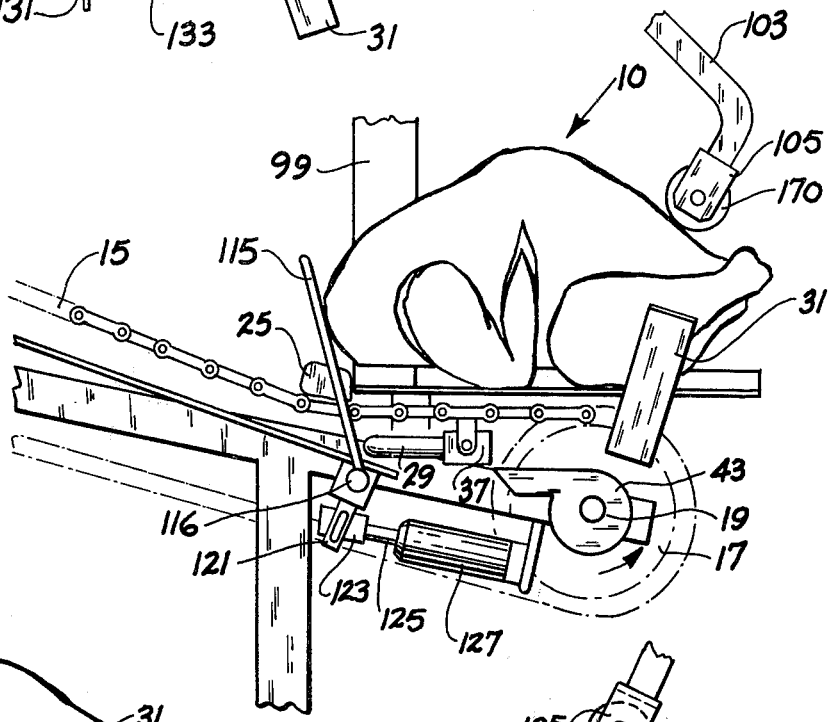
Figure 14:
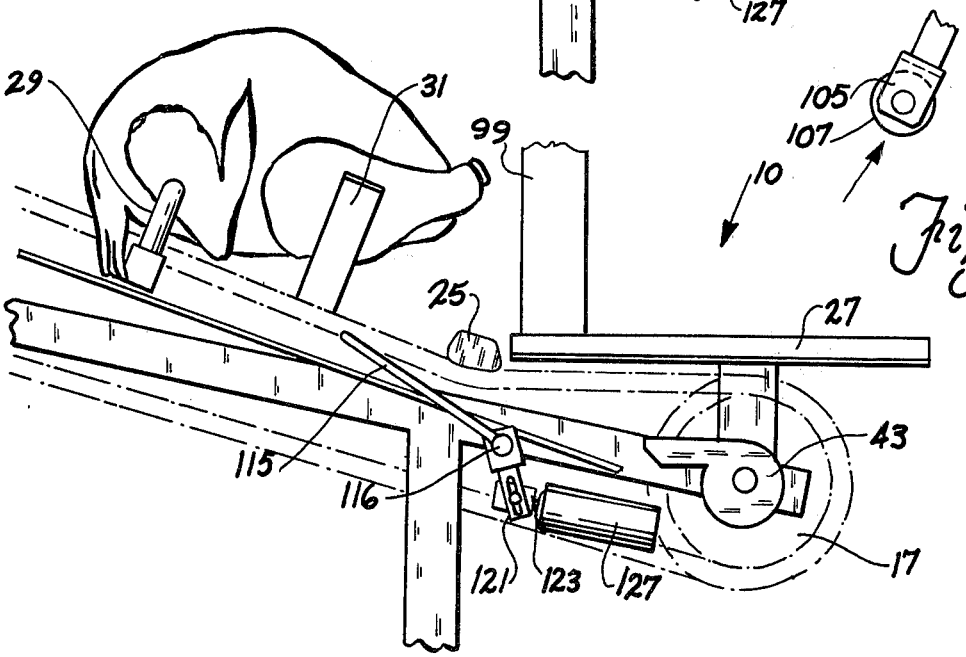
Figure 16:
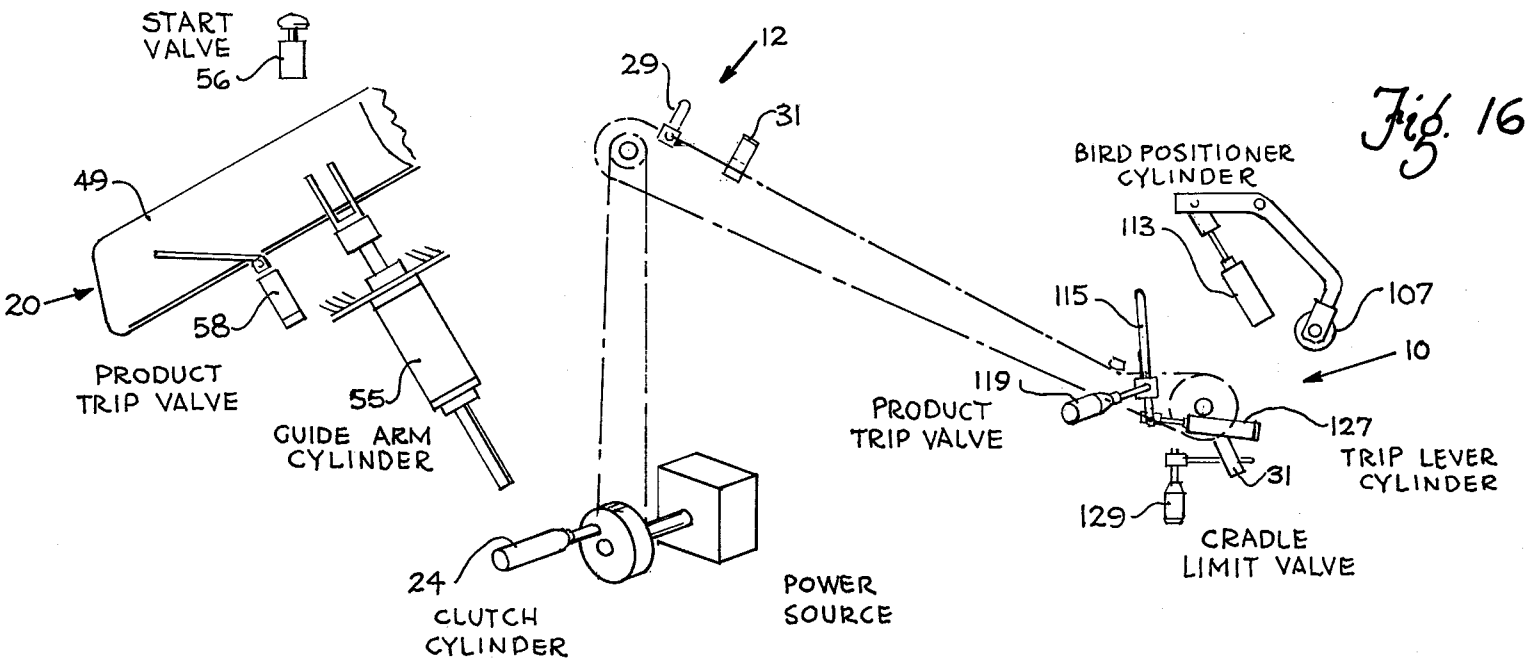

FIGS. 12, 13, and 14 are side elevational schematic views showing details of the apparatus according to the invention at various phases in the course of an operation sequence;

FIG. 15 is a fragmentary end-elevational view showing details of the bird positioner means shown in FIG. 8; and, FIG. 16 is a schematic diagram of a control circuit of apparatus according to the invention.

In general, the present invention comprehends a method for packaging an article in a close fitting flexible plastic film packaging bag, which method comprises the steps of:

(a) positioning and aligning an article in a preselected packaging orientation at an article pickup station; (b) picking up and advancing the aligned article along a first locus from said article pickup station to a holding station at a preselected elevation above a bagged article removal station; (c) positioning a plastic film packaging bag at said bagged article removal station, said bag having a size selected to be commensurate with the size of said article; (d) stretch-opening at least the mouth portion of said plastic film packaging bag at said bagged article removal station under a positive opening force less than the tensile strength of the plastic film of said bag, but sufficient to provide an opening size and configuration commensurate with the largest transverse cross section of the article being packaged; (e) directing the article into a gravitationally motivated advance along a downwardly extending second locus from said holding station towards said bagged article removal station and into the stretched-open packaging bag; (f) relaxing the stretched open portion of said packaging bag; and (g) removing the bag containing said article from the bagged article removal station.

In a preferred embodiment, the present invention comprehends a method for packaging a shaped article of irregular configuration such as poultry in a close fitting flexible plastic film packaging bag, which method comprises the steps of: (a) positioning and aligning a shaped article in a preselected packaging orientation at an article pickup station; (b) picking up and advancing the aligned article along a first locus from said article pickup station to a holding station at a preselected elevation above a bagged article removal station; (c) holding the shaped article in a packaging aligned orientation during the course of its first locus advance; (d) positioning a plastic film packaging bag at said bagged article removal station, said bag having a size selected to be commensurate with the size of said article; (e) coaligning and coorienting said plastic film packaging bag with a packaging-oriented shaped article; (f) stretch-opening at least the mouth portion of said plastic film packaging bag at said bagged article removal station under a positive opening force less than the tensile strength of the plastic film of said bag, but sufficient to provide an opening size and configuration commensurate with the largest transverse cross section of the shaped article being packaged; (g) directing the article into a gravitationally motivated advance along a downwardly extending second locus from said holding station towards said bagged article removal station; (h) holding the shaped article in its packaging aligned orientation during the course of its second locus advance; (i) receiving the shaped article into said coaligned and cooriented plastic film packaging bag; (j) relaxing the stretched open portion of said packaging bag; and (k) removing the bag containing the shaped article from the bagged article removal station.

In its apparatus aspects, the present invention comprehends an apparatus for packaging an article in a close fitting flexible plastic film packaging bag comprising, in combination; (a) a structural frame having a proximal end and a distal end; (b) a conveyor mounted moveably on said frame, having a first end located at the proximal end of said frame, and having a second end located at a point removed from the proximal end of said frame; (c) an article cradle surmounting the conveyor, arranged to pick up an article at the proximal end of the frame and maintain said article in a preselected packaging orientation during transport thereof; (d) article alignment means at the proximal end of the frame arranged and disposed to position an article being packaged into a preselected packaging orientation for pickup engagement by the article cradle surmounting the conveyor; (e) packaging bag holding means at the distal end of the frame, positioned at an elevation below said second conveyor end; (f) a gravity slide extending downwardly from said second conveyor end to said bag holding means; and (g) article guide means extending substantially parallel with said gravity slide, arranged to maintain said article in said preselected packaging orientation while it is on said gravity slide.

In a preferred apparatus embodiment, the present invention comprehends an apparatus for packaging a shaped article of irregular configuration such as poultry in a close fitting flexible plastic film packaging bag comprising, in combination: (a) a structural frame having a proximal end and a distal end; (b) a conveyor mounted moveably on said frame, having a first end located at the proximal end of said frame, and having a second end located at a point removed from the proximal end of said frame; (c) an article cradle surmounting the conveyor, arranged to pick up a shaped article at the proximal end of the frame and maintain said article in a preselected packaging orientation during transport thereof; (d) shaped article alignment means at the proximal end of the frame arranged and disposed to position a shaped article being packaged into a preselected packaging orientation for pickup engagement by the article cradle surmounting the conveyor; (e) packaging bag holding means at the distal end of the frame positioned at an elevation below said second conveyor end and moveable between a retracted position and an expanded position whereby it is adapted to hold a packaging bag stretched open at least at the mouth portion thereof; (f) a gravity slide extending downwardly from said second conveyor end to said bag holding means; and, (g) shaped article guide means extending substantially parallel with said gravity slide, arranged to maintain said shaped article in said preselected packaging orientation while it is on said gravity slide.

The apparatus invention also comprehends means to control and sequentially operate the conveyor, the article alignment means, and the bag holding means in proper order to advance a shaped article such as poultry from the article pickup station to a holding station at the second conveyor end, and thence into a plastic film packaging bag stretched open at the bagged article removal station.

With reference to the drawings, apparatus according to the invention comprises a frame 11, formed with upper members rising to meet at a high point or apex 13. Two parallel flights of endless conveyor roller chain 15 extend between and ride on idler sprockets 17 rotatably mounted on an idler sprocket shaft 19 extending transversely of frame 11 at the input end of the apparatus, to the right of FIG. 1 of the drawings in the illustrated embodiment, and drive sprockets 21 mounted on a drive shaft 23 extending transversely of frame 11 at the apex 13. The drive shaft 23 is driven by any suitable power source connected to a pneumatic clutch 24 adapted to rotate the drive sprockets 21 and move the roller chain upper flight from a pickup station 10 of the machine in an upward direction towards a holding station 12 at the apex 13. A chain guide shoe 25 is provided for each chain, mounted on frame 11 and arranged to depress the chains near their lower ends into a horizontal run in order to permit their passage beneath a product pickup platform 27, upon which the birds to be bagged are deposited as brought up to the input end of the apparatus by a feed conveyor, not shown. The product pickup platform 27 is provided with product aligning rails 26, which serve to center and align the birds for engagement (at pickup station 10) with carriage or bird cardling elements. A product slide support 14 extends from the pickup station 10 of the appartus up to the apex 13, arranged and disposed centrally and longitudinally of the conveyor roller chain flights. Side wing support guides 16 are provided and also extend from the input end up to the apex of the apparatus in parallel array with the conveyor flights. The product slide support 14 serves as a sliding surface for any portions, neck skin flaps for instance, which may hang down from the birds, and the side wing support guides 16 serve to support and guide the wings of the birds as they are conveyed from pickup station 10 up to a product holding station 12 adjacent the apex 13 of the apparatus.

The conveyor chains 15 mount one or more sets of bird cradling carriages or jigs, each comprising a pair of front fingers 29 and a pair of rear fingers 31. Two sets are shown in the illustrated embodiment equidistantly spaced apart on the conveyor 15.

Figure 9:
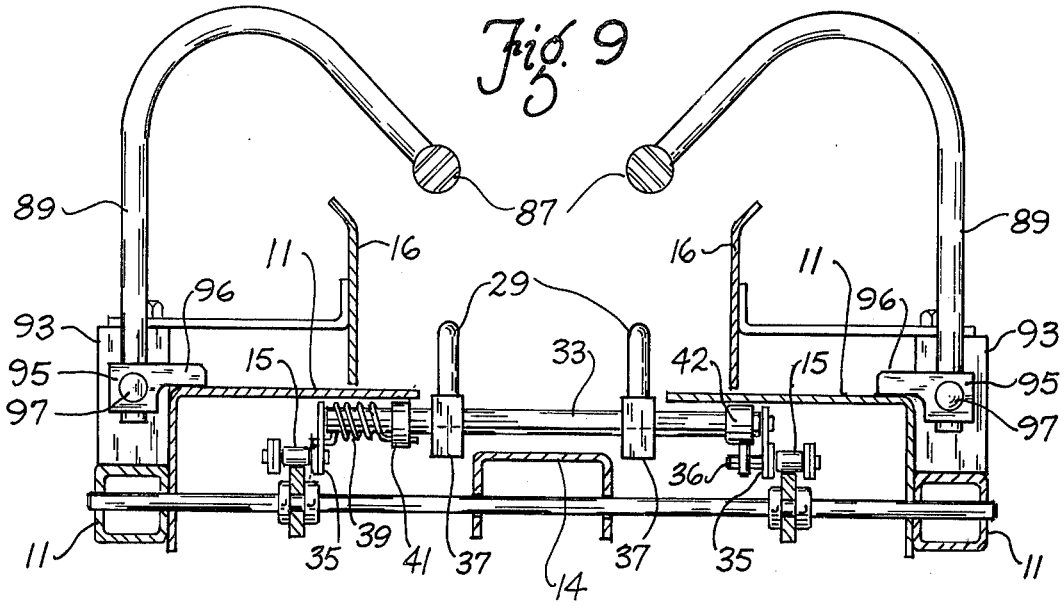
FIG. 9 is a sectional view taken along the section lines 9—9 of FIG. 1, showing details of the front fingers of a bird cradling carriage and bird hold-down rails of apparatus according to the invention.
Figure 11:
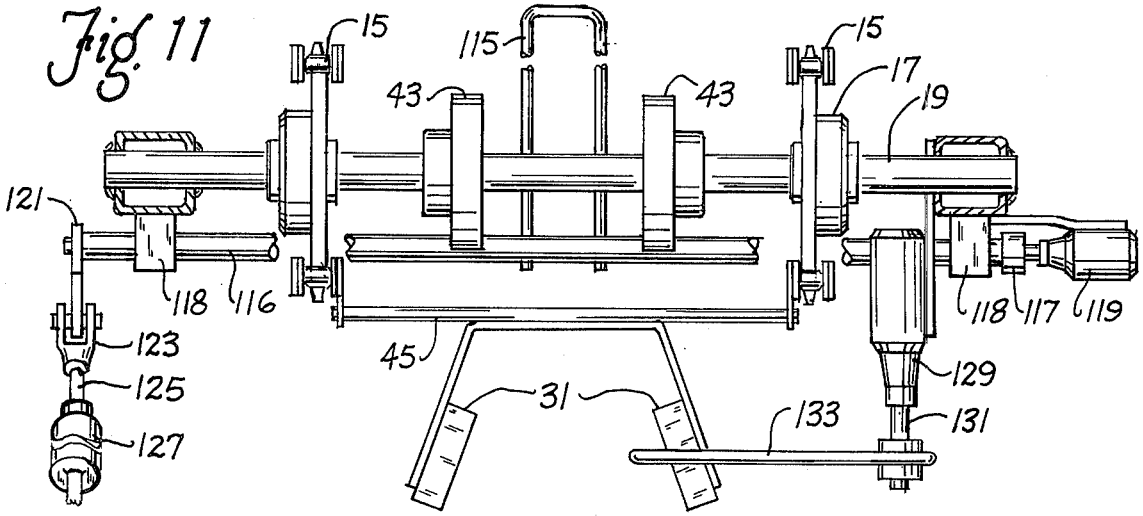
FIG. 11 is a sectional view taken along the section lines 11—11 of FIG. 1, showing details of some control elements of apparatus according to the invention.

FIG. 9 of the drawings shows the arrangement of the front fingers 29 detail. A shaft 33 is journaled between a pair of link plates 35 attached to the conveyor chains 15, and mounts camming blocks 37 from which the front fingers 29 extend. A torsion spring 39 connects between a collar 41 affixed on shaft 33 and one of the link plates 35, the one to the left as shown in FIG. 9. Spring 39 is biased to erect front fingers 29 in a position upwardly normal to the inclined locus of the upper traverse of the conveyor flights. The finger 29 position is predetermined by stop collar 42 secured on the right end of shaft 33, engaging pin 36 extended from link plate 35. As shown in FIGS. 11 and 12, cams 43 on the idler sprocket shaft 19 are arranged to engage the camming blocks 37 and tilt the front fingers 29 through ninety degrees into a retracted position as they pass beneath the rear end of the bird about to be lifted and carried from product pickup platform 27.

Figure 10:
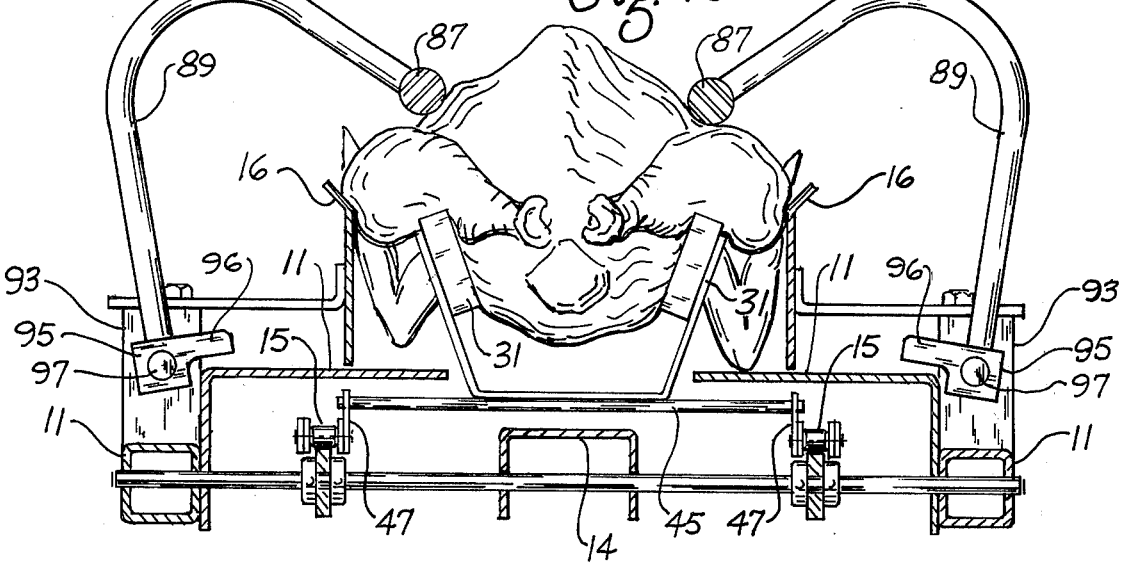
FIG. 10 is a sectional view taken along the section lines 10—10 of FIG. 1, showing details of the rear fingers of a bird cradling carriage and bird hold-down rails of apparatus according to the invention shown with a bird positioned therein.

FIG. 10 of the drawings shows the arrangement of the rear fingers 31 which define a cradling configuration extending from a cross bar 45 mounted between a pair of link plates 47 attached to the conveyor chains 15. In FIG. 13 camming block 37 is shown just leaving the cam 43 surface to be rotated into an erect position thereby lifting and cradling the poultry product between the front fingers 29 and rear fingers 31.

Figure 1:
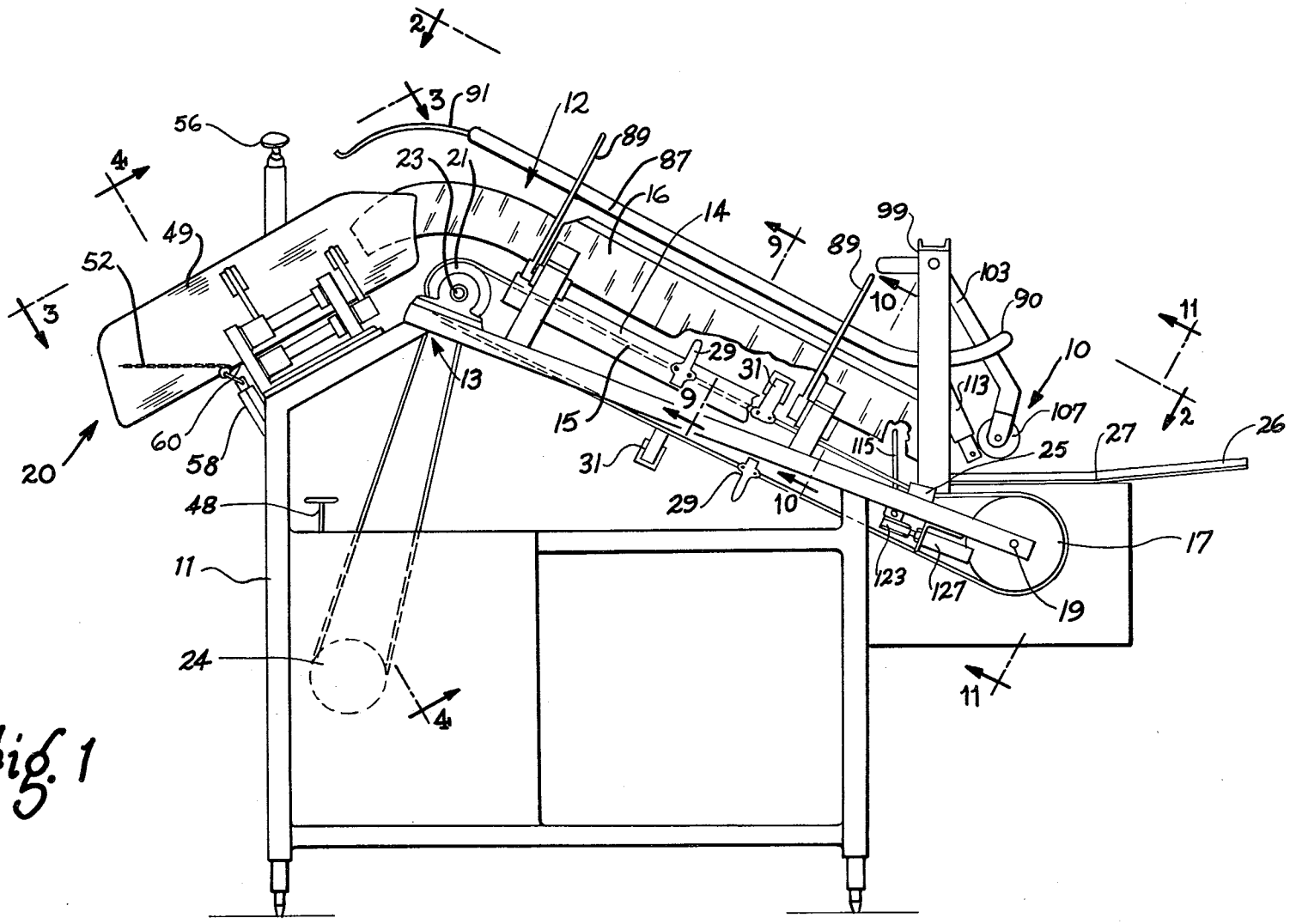
Figure 4:
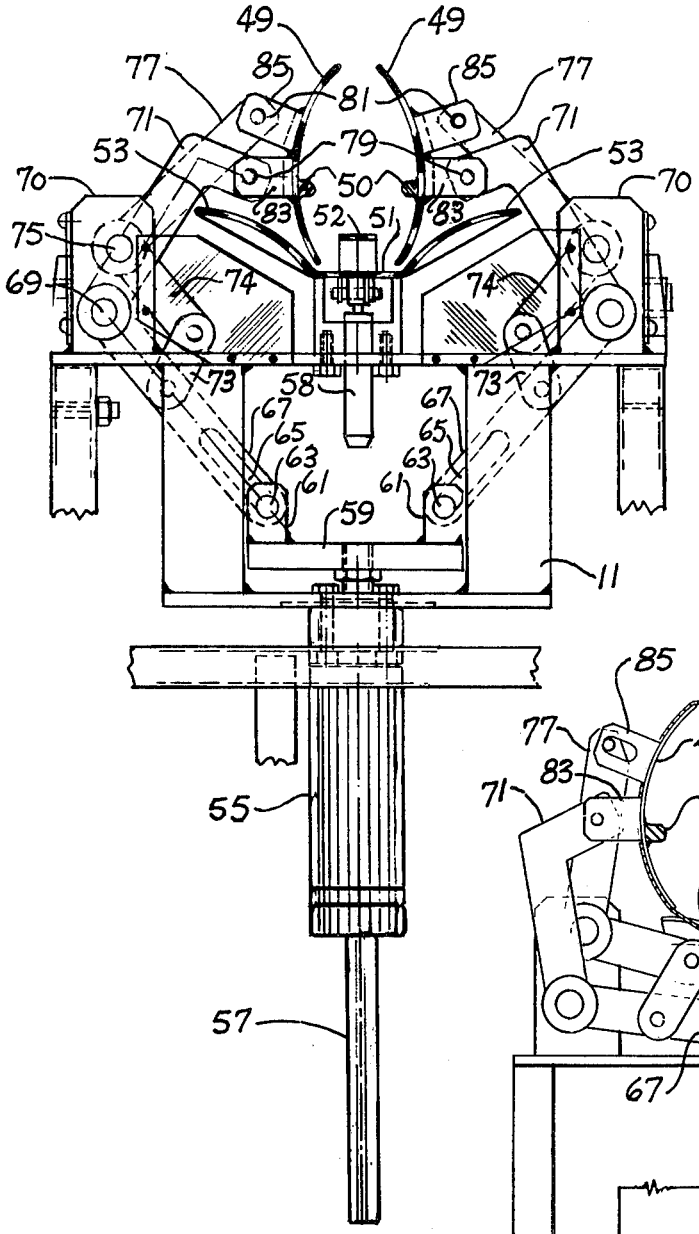
FIG. 4 is a sectional view taken along the section lines 4—4 of FIG. 1 showing details of the bag expanding and product insertion guide portion of the apparatus in the retracted position.
Figure 5:
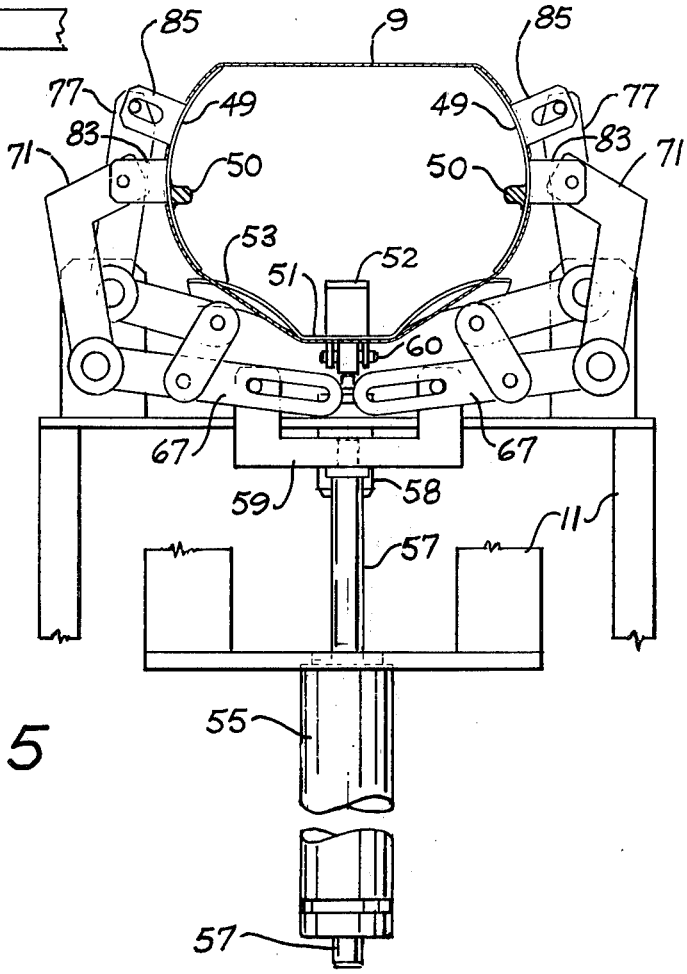
FIG. 5 is the apparatus of FIG. 4 shown in the expanded position.

The bag extending and product insertion guide componentry of the apparatus is shown to the left of drawing FIG. 1 and in sectional detail in FIGS. 4 and 5. It comprises a pair of elongate arcuately sectioned arms 49 extending downwardly from the apex 13 towards the product discharge end of the apparatus, shown as bagged article removal station 20 to the left in the illustrated embodiment of FIG. 1 of the drawings. A stationary slide 51 with arcuate sides 53, is provided with operating linkage described below, to selectively expand and retract, or collapse the arms 49. Each of the bag expansion and product guide arms 49 mounts a longitudinally extending product guide rail 50 on its inner concave surface which resists twisting or rotational movement of the birds sliding down through the insertion guide assembly of the apparatus.

With reference to the cross-sectional views shown in FIGS. 4 and 5 of the drawings, it is seen that the arcuately sectioned arms 49 convex outwardly of the longitudinal center of the apparatus and the arcuate sides 53 of the stationary slide 51 convex upwardly and inwardly. Thus when the arms 49 are moved by the operating linkage from their retracted position as shown in FIG. 4 into their expanded position as shown in FIG. 5, the curved surface of the arms and the slide sides combine to form an opening or passage with a cross-sectional configuration nicely similar to the cross-section of a turkey carcass.

The expansion and retraction movement of the bag expanding and product insertion guide arms 49 is effected by means of a pneumatically actuated double ended cylinder 55 fastened to frame 11. The upper end of extended piston rod 57 of cylinder 55 is secured to crosshead 59. Clevises 61 extend from crosshead 59 slidably connecting bellcrank levers 67 thereto by clevis pivot pins 63 riding in bellcrank lever slots 65. The bellcrank levers 67 are fixedly attached to respective pivot shafts 69 journaled in brackets 70 to move pivotally, the upper end 71 of levers 67 being arranged to extend parallel to the arms 49 and stationary slide 51. The lower end of levers 67 connect to secondary operating arms 77 through bar linkages 73, 74 and idler shafts 75. The operating arms 77 connect at their respective outboard ends through pivot pins 79, 81, to clevises 83, 85, attached to the bag expanding guide arms 49. With this arrangement, the product guide and bag expanding arms 49 will move from the retracted position shown in FIG. 4, outward and upward into the expanded position shown in FIG. 5 whenever the cylinder 55 is pneumatically energized to move piston rod 57 from its lower position of FIG. 4 to its raised position as shown in FIG. 5.

Figure 6:
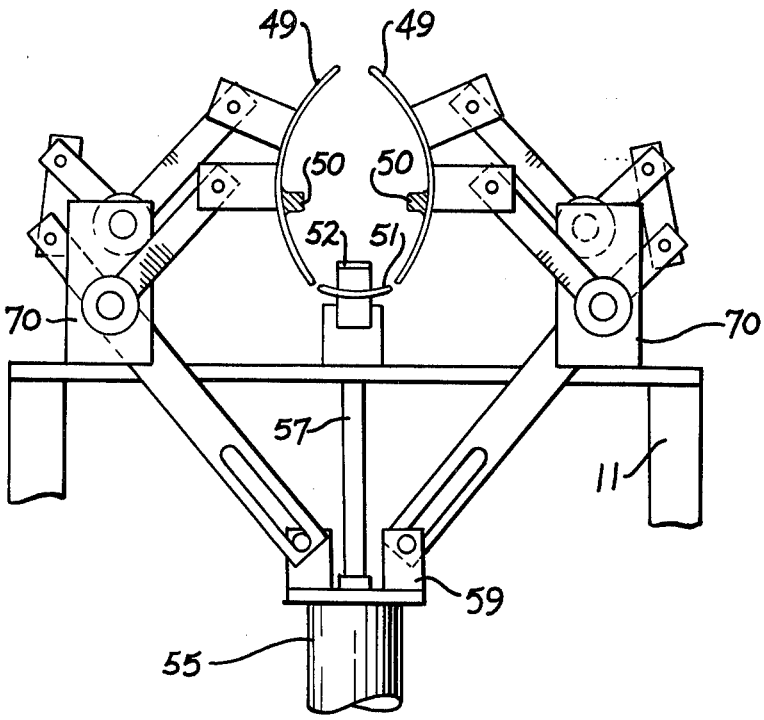
FIG. 6 is a sectional view showing details of an alternative arrangement of bag expanding and product insertion guide elements according to the invention in the retracted position.
Figure 7:
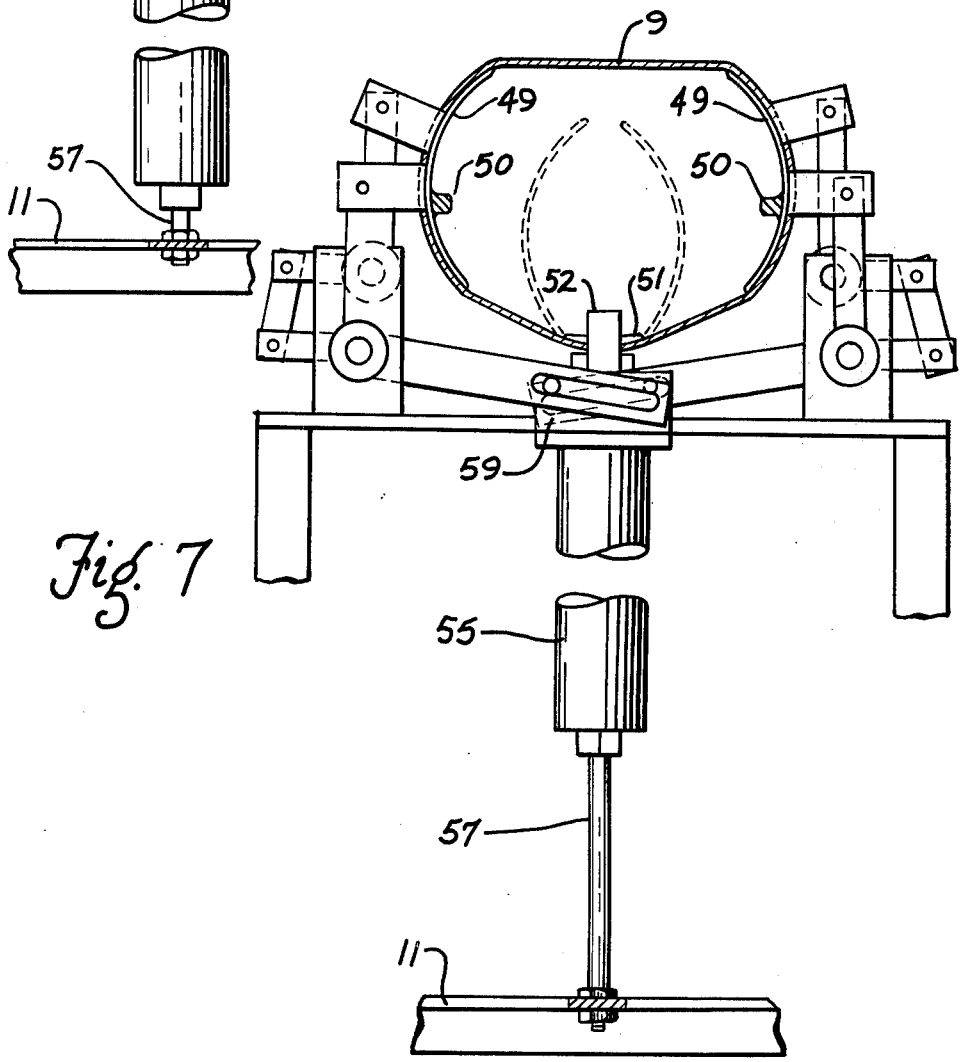
FIG. 7 is the apparatus of FIG. 6 shown in the expanded position.

FIG. 6 shows a sectional view of an alternative arrangement of bag expanding and product insertion guide elements according to the invention. When used on the apparatus the sectional view is taken along the section lines 4—4 of FIG. 1 and shows details of components in the retracted or collapsed position. FIG. 7 is the apparatus of FIG. 6 shown in the expanded position. Reference numbers on FIGS. 6 and 7 refer to components similar to those used in FIGS. 4 and 5. However the extended piston rod 57 of FIG. 6 is secured at each end to frame 11 and the upper end of cylinder 55 is affixed to crosshead 59. When advanced or retracted, the cylinder 55 and crosshead move with respect to the stationary piston rod 57. The related linkage components of FIG. 6 function similarly to those of FIG. 4 to parallely expand and collapse product guide arms 49.

In the packaging operation, a plastic film bag 9 is drawn up over the guide arms 49 in the collasped position. The bag is oriented so that any regions of printing will be in proper preselected alignment with bird orientation as a bird passes down slide 51 and into the bag. Although the entire bag may be pulled up and onto and guide arms 49, in practice it is more efficient to pull only the bag mouth and an initial portion of the bag onto the guide arms. Guide arms 49 are then opened to the expanded position with a force sufficient to stretch open the bag and firmly secure the bag on the guide arms, thereby freeing the hands of the packaging operator to perform other functions in relation to the packaging apparatus. The force of expansion need only be sufficient to secure the bag on the guide arms 49, but it is preferred that the expansive force be great enough to cause the plastic film to yield to the expansive stress and expand circumferentially. In general, air pressure on cylinder 55 is selected to impose an expansive force on the plastic film of bag 9 which is below the tensile strength of the plastic film but which allows the plastic film to circumferentially elongate as much as 30%. Elongation of the plastic film at the bag mouth is the preferred mode of operation since it gives a funnel-like configuration to the bag and allows the poultry article to more easily enter bag 9 from slide 51 while remaining in proper alignment with the printed regions of the bag.

Means for controlling expansion and contraction of the bag expanding guide arms 49 are provided in the pneumatic valve 58 controlling the opening of the guide arms (FIG. 1) and the product sensing arrangement for closing them. As shown in FIGS. 1, 3, 4, and 5 a trip plate 52 is secured by pivot pin 60 to the lower portion of stationary slide 51 and is adapted to trip pneumatic valve 58 when a bird slides down through the guide assembly into an expanded bag mouth 9 (FIG. 5).

Means for controlling the product as it is advanced upwardly by the conveyor on the bird cardling jigs is shown in side elevation in FIGS. 1, 8 and in section in FIGS. 9, 10. A pair of bird holddown guide rods 87 are secured to cantilever arms 89 pivotally mounted on pedestals 93 fastened on frame 11. Holddown rods 87 are provided with a curved entry end 90 and a deflector extension 91 at the apex end of the bird holddown. Cantilever arms 89 are secured to shouldered collars 95 that are mounted on shafts 97 pivotally mounted in pedestals 93.

The weight of rods 87 eccentrically trunnioned on shafts 97 pivoted in pedestals 93, urges them to move inwardly toward the centerline of the conveyor. Shoulders 96 are provided on collars 95 to engage a section of frame 11 (FIG. 9) and limit the inward rotation of rods 87 to a predetermined position for a bird to engage the entry ends 90 of rods 87. Side wing support guides 16 are adjustably secured to pedestals 93 to control protruding portions of a bird as it is advanced by the conveyor from the bird pickup station 10 to holding station 12. Guides 16 impose a restraining force on the bird wings and/or drumsticks to tuck them into close conformation with the bird body (FIG. 10).

Figure 2:
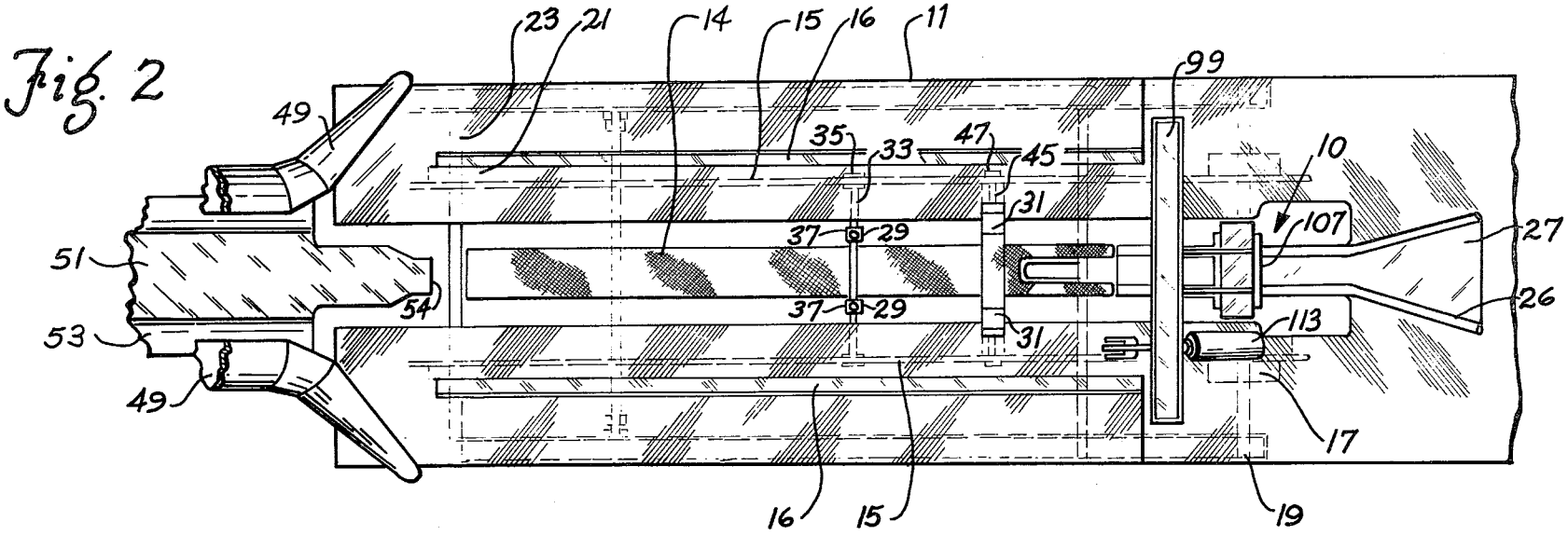
FIG. 2 is taken along the lines 2—2 of FIG. 1, and shows a plan view of the upwardly inclined portion of the apparatus.
Figure 3:
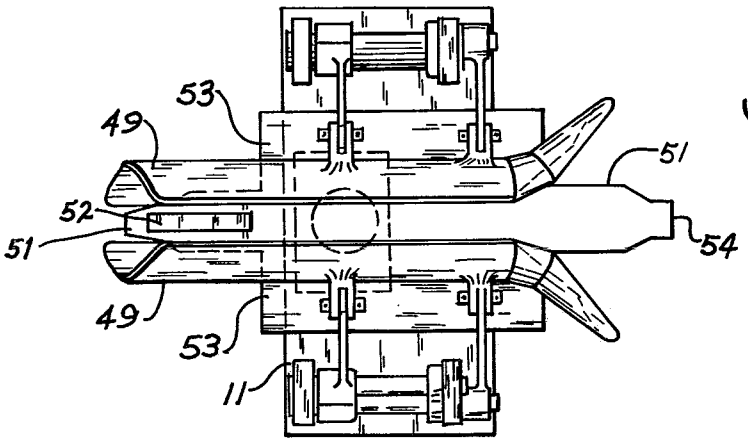
FIG. 3 is taken along the lines 3—3 of FIG. 1, and shows a plan view of the downwardly inclined bag expanding and product insertion guide portion of the apparatus.

Referring now to FIG. 2, it may be seen that there is a gap between the slide support 14 of the conveyor and the gravity slide 51. As the bird reaches the end of the conveyor travel, the loose flap of neck skin will fall into the gap and dangle in a freely draped configuration. When the conveyor advances further to discharge the bird into the gravitational path down slide 51 between arms 49, the skin flap will be brushed by the input edge or tongue 54 of slide 51 and pulled under the bird in close conformation as the body passes over the leading edge and down slide 51. This then gives the bird a more pleasing appearance in the finished package since the neck skin flap is not lumped or wadded in one area of the neck region but is smoothly spread onto the bird body. More importantly, the evenly spread skin flap covers the bird neck where it has been severed and thereby protects the plastic film bag of the finished package from being punctured by any otherwise exposed sharp neckbone edges.

A bird positioner and control means is shown at pickup station 10 in FIGS. 1, 8, 15. Superstructure bracket 99 is a vertical extension of frame 11 arranged to bridge a poultry article cradled on a jig at pickup station 10, the entry end of the conveyor. A pair of bellcrank levers 103 is secured to shaft 101 pivotally mounted on bracket 99. The entry ends of levers 103 are secured to a U-shaped bracket 105 rotatably mounting roller 107. The other ends of levers 103 are pivotally secured to clevis 109, in turn fastened to piston rod 111 of pneumatic cylinder 113 secured to frame 11. Operation of the positioner to immobilize and properly align a bird indexed on product platform 27 at the pickup station is initiated when an operator advances the bird along the product aligning rails 26 to contact trip lever 115 (FIG. 13). As shown in FIG. 11, trip lever 115 is secured to shaft 116 pivotally secured in bearings 118 to frame 11. A right end extension of shaft 116 is axially connected by coupling 117 to pneumatic limit valve 119 fastened to frame 11 and adapted to trip when a bird contacts trip lever 115. A lever 121 is secured to a left end extension of shaft 116 that is pivotally secured to clevis 123, in turn fastened to piston rod 125 of cylinder 127 secured to frame 11. On an appropriate manual actuation of pneumatic start valve 56 (FIG. 1), the pneumatic circuitry described below, deenergizes single acting cylinder 127 to retract rod 125 and rotate trip lever 115 downwardly out of the path of the product advanced along the conveyor locus (FIG. 14), from pickup station 10 toward holding station 12.

Means for controlling the intermittent operation of the conveyor roller chain 15 as described below, in the method of operation is provided by pneumatic limit valve 129 (FIGS. 11, 12) secured to frame 11. Trip lever 133 is secured to shaft 131 of valve 129. When a rear finger 31 of a bird cradling jig returning on the lower flight of conveyor chain 15 to pickup station 12 contacts lever 133, limit valve 129 is tripped to inactivate pneumatic clutch 24, disconnecting drive shaft 23 from the power source and thereby simultaneously halting a first poultry cradle unit of front and rear fingers on the conveyor adjacent the pickup station 10, and halting a second cradle unit on the conveyor at holding station 12.

The control circuitry for operating the apparatus of the invention, as shown schematically in FIG. 16, employs conventional pneumatic components desirable for saftey in cleaning and sanitizing operations required by regulations prescribed for poultry machinery. Equivalent control components can be alternatively employed, as is well known to those skilled in the art.

When pressurized air is connected to the apparatus of the invention, the pneumatic control circuit sets the machine in start position. As shown in FIG. 4, the upper end of cylinder 55 is pressurized to lower crosshead 59 and thereby collapses the product guide arms 49. Referring to FIG. 8, the rod end of bird positioner cylinder 113 is pressurized and the positioner roller 107 is thereby moved to the up position, allowing a next following bird to be fed into and aligned at pickup station 10 (FIG. 14). As shown in FIG. 13, the single acting trip lever cylinder 127 is pressurized, the rod 125 is extended thereby rotating product trip lever 115 to the raised position. The clutch cylinder 24 is exhausted thereby disengaging the clutch from the power source. With the operating components set in the condition described above, the machine is in the proper mode to start successive poultry product bagging operations.

A first bird is moved from a supply conveyor (not shown). It is then axially aligned with the centerline of the apparatus on rails 26 and advanced to trip the lever 115 as shown in FIG. 13, thereby activating limit valve 119 which in turn pressurizes cylinder 113 to lower bird positioner roller 107, thus immobilizing the oriented bird at pickup station 10. An operator now selects a bag of proper size for the bird, opens and places the bag 9 over the collapsed bag expanding guide arms 49 and stationary slide 51, then activates start valve 56 by pushing the button therefor (FIG. 1). The pneumatic control circuit then activates cylinder 55 expanding the guide arms 49 thus opening and stretching the bag 9 to the configuration shown in FIG. 5. Simultaneously the trip lever cylinder 127 is caused to be deenergized thereby rotating trip lever 115 down out of the path of the conveyor 15 (FIG. 14) and clutch cylinder 24 is energized to connect the power source to drive shaft 23, thereby putting the conveyor in motion and carrying the first bird on the fingers of a first cradle unit, toward the holding station 12. As the conveyor 15 is put into motion, the front fingers 29 are released from cam surface 43 (FIG. 13) and are rotated into erect position thereby lifting and cradling fore end of the aligned immobilized first bird. The rear fingers 31 follow about sprocket 17 thereby lifting the aft end to maintain the cradled bird in the aligned position as it is advanced toward the holding station 12.

As the product loaded cradle or carriage is advanced upwardly, it moves the aligned bird under the bird holddown guide rods 87 which engage the carcass and provide a downward pressure on the both sides of the keel bone of the bird to maintain it in the preferred aligned cradle position on the fingers 29 and 31. Guides 16 and product slide 14 confine the wings, legs and skin flap, during the cradle advance to holding station 12. As the product loaded first cradle advances upwardly, a second alternate empty cradle which has been heretofore positioned at holding station 12, now descends along the lower flight of the conveyor until the rear fingers 31 engage trip lever 133 (FIG. 12) thereby activating cradle stop limit valve 129. This action deenergizes clutch cylinder 24 thereby disconnecting drive shaft 23 from the power source and halting the product loaded first cradle unit on the conveyor at holding station 12. At the same time, cylinder 127 is pressurized to rotate trip lever 115 to the raised position shown in FIG. 13.

The machine is now in the proper mode to position a second, succeeding poultry product at the pickup station 10. The second bird is aligned on rails 26 and fed into station 10. Trip lever 115 is activated when contacted by the fore end of the bird, thereby dropping roller 107 thus immobilizing the second bird in the preferred aligned pickup position, and thereby placing the apparatus in ready condition to have the succeeding bird picked up by the second cradle unit. If product trip lever 115 is not activated, the machine cycle start valve 56 is inoperative.

When the start valve 56 is activated and the second bird is in proper aligned position at pickup station 10, the succeeding machine cycle is started and the second bird is picked up and cradled on the second unit described above for the first bird on the first cradle unit. The first bird has been aligned at holding station 12 by the cradling fingers 29, 31, and by the pair of holddown bars 87, and by the wing support guides 16. When the conveyor 15 starts to advance, the bird at station 12 is trajected down the sloping passage comprising the expanded guide arms 49, product slide 51, and expanded bag 9. As the first bird is transferred from the cradle at the apex 13 of the machine, into the sloping passage, the leading free neck skin flap is retarded and folded back under the bird body by the input edge or tongue 54 of the product slide 51 (FIG. 2). During its advance on the gravity slide through the sloping passage, the bird is maintained in the preferred aligned position by contact with guide rails 50 affixed to the inner surfaces of guide arms 49. As the bird travels downwardly through the sloping passage it trips lever 52 thereby activating the valve 58 which in turn exhausts the lower end of the cylinder 55 and simultaneously pressurizes the upper end thereof. Crosshead 59 is lowered and the interconnecting linkage starts to close expanding arms 49 thus releasing the bagged product from the expanding arms to be deposited on a takeway conveyor, now shown. The expanding fingers 49 are collapsed as shown in FIG. 4 and are thus ready to receive the succeeding bag.

As the cycle was started, the succeeding bird loaded second cradle unit from pickup station 10 was conveyed to holding station 12. The first cradle unit that was emptied of the first bird adjacent holding station 12, now descends along the lower flight of the conveyor 15 until the rear fingers 31 thereof contact lever 133 thus providing the signal to terminate that machine cycle. The operator can then place a next preselected size bag onto the collapsed guide arms 49 and stationary slide 51. If a succeeding aligned product is properly in place at pickup station 10, the machine cycle can be successively repeated as described above.

Some commercial poultry operations employ a first system whereby they bag the product first, and then weigh it and mark the weight on the bag as demanded by marketing practices. Other commercial poultry operations employ a second system whereby they weigh the bird first, mark the weight on an unfilled bag of a size commensurate with the weight of the product, and associate the bag with the bird through the bagging operation. The apparatus of the invention is readily adaptable to either of the above described systems. When the first system is practiced, the bird aligned in position at holding station 12 is clearly visible to the operator for gauging as to size, thus permitting the operator to preselect a bag of proper size for the product to be bagged. When the second system is practiced, a second operator servicing the alignment and loading of product at pickup station 10 can weigh the bird, preselect the bag, mark the weight on the bag and place it on the top of the bird. Then the bird and the associated marked bag is conveyed to the holding station 12 where the bagging operator can readily remove the bag from the bird, place it on the expanding arms, start the machine cycle, and bag the bird in the associated preselected marked bag.

From the foregoing description of the present invention, those skilled in the art will recognize that the packaging method relies upon inertia as well as gravity to package the poultry article. When the conveyor is stationary with the cradle containing a first bird at the holding station 12 and the conveyor is then indexed to move the succeeding bird from the pickup station 10 to the holding station, the conveyor will project the bird off of the end of the conveyor as first the front fingers 29 and then the rear fingers 31 are turned under to pass on the lower conveyor flight back to the pickup station 10 for the next succeeding bird. The inertia of the bird being projected off of the conveyor is quickly influenced by gravity, and the bird drops to slide 51 by means of which it then passes into the expanded bag 9.

Accordingly, those skilled in the art will recognize that the apparatus concepts disclosed hereinabove may be modified in various ways while still obtaining the benefits of the present invention. For example, the slide 51 between arms 49 could be in a horizontal or even an upward orientation. In such an embodiment, gravity would not be used for passing the bird into the expanded bag. Instead, the conveyor system would be modified to move with such kinetic energy that the bird would be projected off of the cradle and into the bag without the assistence of gravity.

The apparatus disclosed also shows an upwardly inclined conveyor with the pickup station 10 and the package removal station 20 at substantially the same elevation. This configuration is preferred since poultry packaging lines will normally have input conveyors and product removal conveyors at the same height in relation to the floor. However, it is also within the scope of the present invention to provide an apparatus having a horizontal conveyor with the package removal station at an elevation below the article pickup station. Similarly, the conveyor could be downwardly inclined with the pickup station at the high end of the conveyor and the package removal station at the low conveyor end.

Since these and other modifications to the present invention will doubtlessly occur to those skilled in the art, it is intended that the foregoing description be taken as illustrative only, and not be construed in any limiting sense.

What is claimed is:

1. Apparatus for packaging an article in a close fitting flexible plastic film packaging bag comprising, in combination:

a. a structural frame having a proximal end and a distal end;

b. a conveyor mounted movably on said frame, having a first end located at the proximal end of said frame, and having a second end located at a point removed from the proximal end of said frame;

c. an article cradle surmounting the conveyor, arranged to pick up an article at the proximal end of the frame and maintain said article in a preselected packaging orientation during transport thereof;

d. article alignment means at the proximal end of the frame arranged and disposed to position an article being packaged into a preselected packaging orientation for pickup engagement by the article cradle surmounting the conveyor;

e. packaging bag holding means at the distal end of the frame, positioned at an elevation below said second conveyor end;

f. a gravity slide extending downwardly from said second conveyor end to said bag holding means; and, g. article guide means extending substantially parallel with said gravity slide, arranged to maintain said article in said preselected packaging orientation while it is on said gravity slide.

2. Apparatus according to claim 1 wherein hold-down means is positioned at said conveyor and is adapted to exert a holding force on an article contained in said article cradle during conveyor movement.

3. Apparatus according to claim 2 wherein said hold-down means comprises at least one elongated member positioned above said conveyor and adapted to exert a downward force upon an article contained in said article cradle.

4. Apparatus according to claim 1 wherein said conveyor is upwardly inclined, said point removed is at a preselected elevation above the first end of said conveyor and above said packaging bag holding means.

5. Apparatus according to claim 4 wherein said bag holding means is at the same elevation as said first conveyor end.

6. Apparatus for packaging a shaped article of irregular configuration such as poultry in a close fitting flexible plastic film packaging bag comprising, in combination:

a. a structural frame having a proximal end and a distal end;

b. a conveyor mounted movably on said frame, having a first end located at the proximal end of said frame, and having a second end extending to a point removed from the proximal end of said frame;

c. an article cradle surmounting the conveyor, arranged to pick up a shaped article at the proximal end of the frame and maintain said article in a preselected packaging orientation during transport thereof;

d. shaped article alignment means at the proximal end of the frame arranged and disposed to position a shaped article being packaged into a preselected packaging orientation for pick-up engagement by the article cradle surmounting the conveyor;

e. packaging bag holding means at the distal end of the frame positioned at an elevation below said second conveyor end and movable between a retracted position and an expanded position whereby it is adapted to hold a packaging bag stretched open at least at the mouth portion thereof;

f. a gravity slide extending downwardly from said second conveyor end to said bag holding means; and, g. shaped article guide means extending substantially parallel with said gravity slide, arranged to maintain said shaped article in said preselected packaging orientation while it is on said gravity slide.

7. Apparatus according to claim 6 wherein said conveyor is upwardly inclined, said second end is at a preselected elevation above the first end and above said packaging bag holding means.

8. Apparatus according to claim 7 wherein said bag holding means is at the same elevation as said first conveyor end.

9. Apparatus according to claim 6 wherein said packaging bag holding means includes means adapted to expand said holding means with a force not greater than the tensile strength of a packaging bag held thereon.

10. Apparatus according to claim 9 wherein said force is sufficient to elongate the stretched open portion of a plastic film packaging bag held thereon.

11. Apparatus according to claim 6 wherein hold-down means is positioned at said conveyor and is adapted to exert a holding force on an article contained in said article cradle during conveyor movement.

12. Apparatus according to claim 11, wherein said hold-down means comprises at least one elongated member positioned above said conveyor and adapted to exert a downward force upon an article contained in said article cradle.

13. Apparatus according to claim 6 adapted to package a poultry article and including means positioned adjacent to said conveyor and adapted to tuck poultry wings into close conformation with the poultry body.

14. Apparatus according to claim 6 adapted to package a poultry article and including means adapted to tuck a loose flap of poultry neck skin into close conformation with the poultry body.

15. Apparatus according to claim 6 adapted to package a poultry article and including means adapted to tuck poultry drumsticks into close conformation with the poultry body.

* * * * *